United States Patent [19]

Kohyama et al.

[11] Patent Number: 4,596,455

[45] Date of Patent: Jun. 24, 1986

[54] DEVELOPING APPARATUS

[75] Inventors: Mitsuaki Kohyama, Tokyo; Toshihiro Kasai, Yokohama, both of Japan

[73] Assignee: Kabushiki Kaisha Toshiba, Kawasaki, Japan

[21] Appl. No.: 650,507

[22] Filed: Sep. 14, 1984

[30] Foreign Application Priority Data

Sep. 20, 1983 [JP] Japan ..... 58-144558[U]

[51] Int. Cl.[4] ..... G03G 15/00

[52] U.S. Cl. ..... 355/3 DD; 118/656; 118/657; 118/658

[58] Field of Search ..... 355/3 DD, 14 D, 655; 118/656, 657, 658

[56] References Cited

U.S. PATENT DOCUMENTS

| | | | |
|---|---|---|---|
| 3,232,190 | 2/1966 | Willmott et al. . | |
| 3,788,275 | 1/1974 | Hanson | 118/658 |
| 3,866,574 | 2/1975 | Hardennrook et al. . | |
| 3,906,899 | 9/1975 | Harpavat | 118/655 |
| 3,915,121 | 10/1975 | Wilcox | 118/658 |
| 4,232,628 | 11/1980 | Shelffo . | |
| 4,458,627 | 6/1984 | Hosono et al. | 118/657 |

FOREIGN PATENT DOCUMENTS

| | | | |
|---|---|---|---|
| 2816621 | 10/1979 | Fed. Rep. of Germany | 355/3 DD |
| 2947235 | 4/1981 | Fed. Rep. of Germany | 355/3 DD |
| 947566 | 5/1966 | Japan . | |
| 4303779 | 4/1979 | Japan . | |
| 0111066 | 7/1983 | Japan | 355/3 DD |

*Primary Examiner*—A. T. Grimley
*Assistant Examiner*—David Warren
*Attorney, Agent, or Firm*—Cushman Darby & Cushman

[57] ABSTRACT

A developing apparatus is provided with a developing roller for carrying a toner thereon and an elastic blade pressed against the surface of the developing roller to apply the toner thereto. The toner is thus applied to the surface of the developing roller by the elastic blade to form a thin layer of the toner on the surface of the developing roller. The thin layer is opposed to a photosensitive drum at a predetermined space to deposit the toner on an electrostatic latent image on the photosensitive drum. Magnets and magnetic particles are provided to prevent the toner from leaking out.

9 Claims, 9 Drawing Figures

DEVELOPING APPARATUS

BACKGROUND OF THE INVENTION

The present invention relates to a developing apparatus for depositing a developing agent on an image carrier with a latent image thereon, thereby developing the latent image.

Development is achieved, for example, when a developing agent (colored powder called toner or developer) which is charged with a polarity opposite to the electric charges forming an electrostatic latent image is electrostatically attracted to the electrostatic latent image. Developing agents include one-component developing agents which consist of a powdery toner only or a toner coated with $SiO_2$ or another additive, and two-component developing agents which are composed of a powdery toner and a carrier as it is called, such as magnetic powder or fine resin powder, glass, etc. In the two-component developing agents, the toner is securely charged by friction with the carrier. To maintain a constant developing density, on the other hand, the mixture ratio between toner and carrier, i.e., toner density, must be kept constant. Requiring no such control of toner density, the one-component developing agents surpasses the two-component developing agents in easy handling.

The one-component developing agents are classified into two types, magnetic and nonmagnetic. In general, a nonmagnetic developing agent is prepared by mixing resin powder with a color agent such as carbon, while a magnetic developing agent is a mixture of resin powder and magnetic powder.

A prior art method using a one-component developing agent is an application of the so-called no-contact developing process stated in Japanese Patent Publication No. 9475/66. In this developing process, an image carrier is opposed to a layer of a developing agent on a developing agent carrier at a fixed space, and a suitable bias is applied to the developing agent layer to fly the developing agent to image portions of an electrostatic latent image on the image carrier. The no-contact developing process is superior to any other developing methods in the following points. Since a developing agent with electric insulating property or high resistance can be used in the process, there is no possibility of defective transfer. Moreover, the developing agent will not cause fog, since it will not be flown to the no-image portions of the electrostatic latent image. In developing an electrostatic latent image by the no-contact developing process, the distance between the image carrier and the developing agent carrier must be minimized for a visible image of higher quality. Naturally, therefore, the developing agent layer on the developing agent carrier needs to be very thin and uniform.

In order to form such a thin layer of developing agent, a toner layer forming method is disclosed in Japanese Patent Disclosure No. 43037/79 in which a thin layer of a magnetic developing agent is formed on a developing agent carrier containing magnetic field generating means therein. According to this method, a uniformly thin layer of magnetic developing agent can be formed with high reliability. Thus, a satisfactory visible image may be obtained by the use of the no-contact developing process.

The no-contact developing process, however, requires as indispensable requisites a magnetic field generating means, i.e., a magnet, and a magnetic developing agent composed of toner and magnetic powder dispersed therein. Thus, this developing process has the following drawbacks:

(1) the use of the magnet in the developing agent carrier renders the apparatus complicated and expensive, constituting a hindrance to the reduction of the size and weight of the apparatus, (2) the magentic developing agent is more expensive than the nonmagnetic one, and (3) containing magnetic powder, the magnetic developing agent is poor in coloring capability and is unsuited for color print.

Thus, the no-contact developing process using the magnetic developing agent has the substantial drawbacks attributed to the use of the magnetic developing agent, as well as many advantages.

Meanwhile, a no-contact developing process using a nonmagnetic developing agent may be considered an ideal developing method which can settle all the problems related to the prior art method.

In the noncontact developing method, which uses nonmagnetic toner, in order to charge the toner and form a stable layer, a toner layer forming an elastic member (hereinafter referred to as an elastic member), which can be pressed against the toner carrier, is used. This elastic member is elastically moved relative to the surface of the toner carrier by the flow of toner, etc. Accordingly, a gap must be provided between the ends of the elastic member and the side wall to allow for this movement. Also, the toner carrier is rotatable and a thin layer of toner is formed on its periphery so a gap must be provided around its end surfaces and side wall as well. But, because the particles of toner are in the 10 $\mu$m range, they leak from these two gaps, which results in a dirty machine.

SUMMARY OF THE INVENTION

The present invention has been made in consideration of the above situation, and has as its object to provide a developing apparatus wherein leakage and dropping of a developing agent from the two end portions of a developing agent carrier is prevented, and the contamination of the interior of a copying machine or the like is eliminated.

DETAILED DESCRIPTION OF THE PREFERRED EMBODIMENTS

One embodiment of a developing apparatus according to the present invention applied to an image forming apparatus will now be described in detail with reference to the accompanying drawings of FIGS. 1 to 6.

Figure 1:
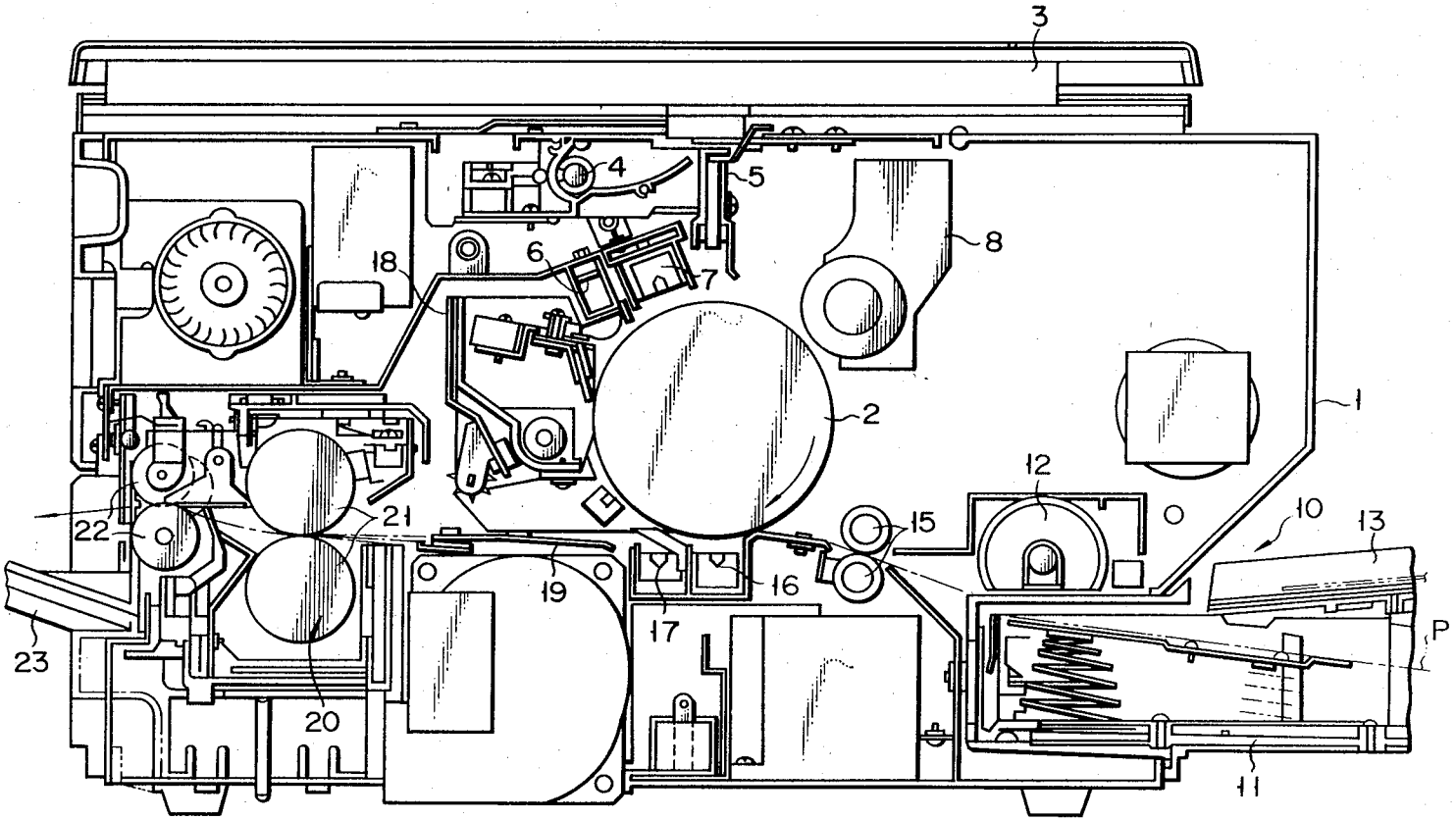
FIG. 1 is a sectional view schematically showing a copying machine using a developing apparatus according to the present invention.

First, the image forming apparatus, e.g., a copying machine, using the developing apparatus of the invention will be described. FIG. 1 is a sectional view schematically showing the copying machine. In FIG. 1, numeral 1 designates a housing of the copying machine. Rotatably disposed in the central portion of the housing 1 is an image carrier, e.g., a photoconductive drum 2 made of selenium, on the surface of which is formed an electrostatic latent image. The photoconductive drum 2 is surrounded by a lamp 4 and a convergent light transmitting member 5 for optically scanning an original paper put on a horizontally reciprocating original table 3 and for forming an electrostatic latent image corresponding to an image of the original paper on the surface of the photoconductive drum 2, a discharge lamp 6 for de-electrifying the surface of the photoconductive drum 2 before the formation of the original image, a charger 7 for uniformly charging the surface of the photoconductive drum 2 after the de-electrification, and a developing apparatus 8 according to the invention for selectively flying a developing agent to the electrostatic latent image on the surface of the photoconductive drum 2 to develop the electrostatic latent image. Thus, the developing apparatus 8 forms a visible image on the surface of the photoconductive drum 2.

A one-component toner such as the nonmagnetic toner mentioned above is mainly used as a developing agent. However, two-component developer can be used where the diameter of a carrier contained in the two-component developer is substantially equal to or smaller than that of a toner contained in the two-component developer.

A paper feeding section 10 is provided at one side portion (right-hand side portion of FIG. 1) of the housing 1. The paper feeding section 10 includes a paper cassette 11 removably attached to the one side portion of the housing 1, a paper supply roller 12 in rolling contact with the uppermost one of sheets P contained in the paper cassette 11 and capable of delivering the sheets P one by one into the housing 1, and a sheet-bypass guide 13 for manual paper supply. Each sheet P delivered from the paper feeding section 10 is regulated for feed timing by a pair of aligning rollers 15, and fed so as to be in rolling contact with the photoconductive drum 2 in a transfer section.

The photoconductive drum 2 is also surrounded by a pre-transfer charger 9, a transfer charger 16 for transferring the developing agent to the sheet to form a visible image thereon, and a separation charger 17 for separating the sheet from the photoconductive drum 2 after transfer. The transfer section is defined between the photoconductive drum 2 and the transfer charger 16. After the developing agent image (visible image) is transferred to the sheet, the sheet is guided to a fixing unit 20 by a conveyor belt 19. The developing agent is fixed by the pressure and heat of a pair of heat rollers 21 which constitute the fixing unit 20. After the fixation, the sheet is discharged onto a tray 23 by a pair of exit rollers 22. After the transfer operation, the developing agent remaining on the surface of the photoconductive drum 2 is removed by a cleaning unit 18.

Figure 2:
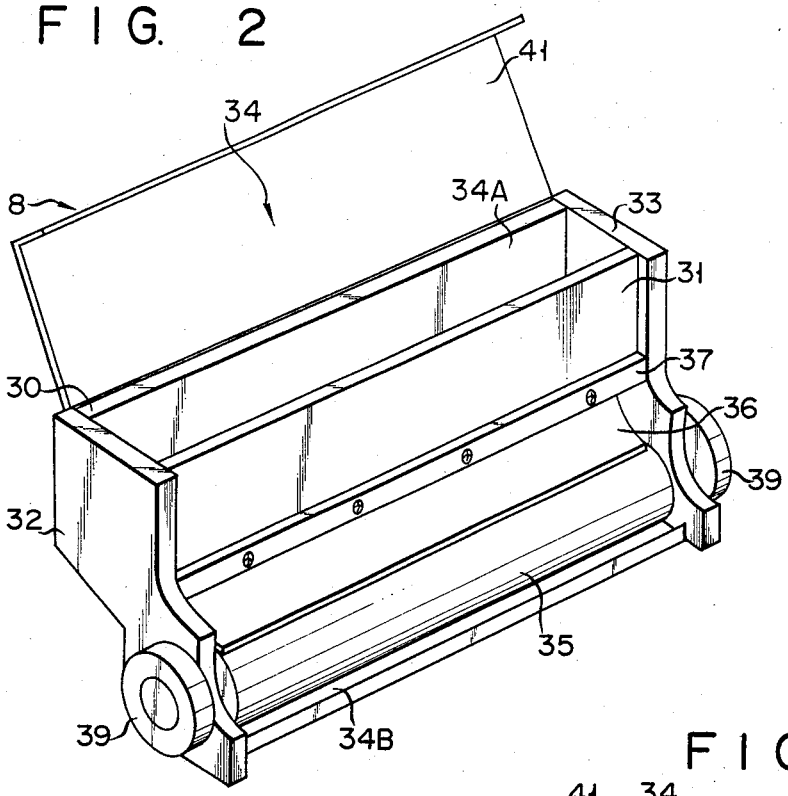
FIG. 2 is a perspective view schematically showing a developing apparatus according to one embodiment of the present invention.
Figure 3:
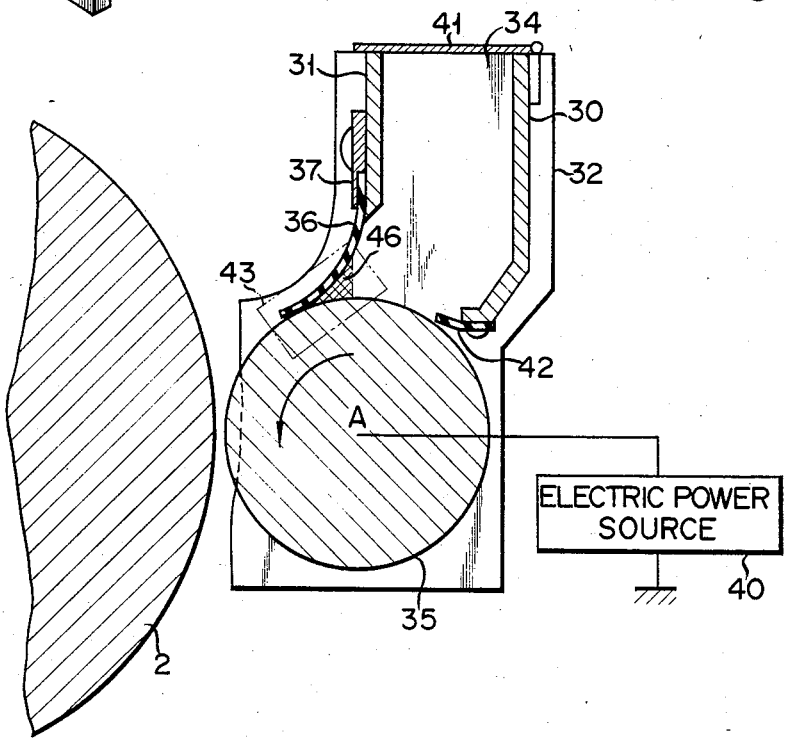
FIG. 3 is a front sectional view schematically showing the developing apparatus of FIG. 2.

The developing apparatus 8 according to the first embodiment of the invention will now be described in detail. FIGS. 2 and 3 are a perspective view and a sectional view, respectively, schematically showing the developing apparatus 8.

The developing apparatus 8 has a housing 34 which contains a nonmagnetic developing agent. The housing 34 is provided with a back frame 30 and a front frame 31 spaced from each other and side frames 32 and 33 attached to both side portions of the frames 30 and 31. The housing 34 is open at both the top and bottom and has a swingable cover member 41 at its top opening 34A. When the cover 41 is up, the developing agent is supplied through the top opening 34A. Disposed near a bottom opening 34B of the housing 34 is a rotatable developing agent carrier, e.g., an aluminum or stainless-steel developing roller 35, which carries the developing agent on its surface. The developing roller 35 is pivotally mounted on the two side frames 32 and 33.

The front frame 31 is fitted with an elastic blade 36 by means of a blade holder 37. The elastic blade 36 is formed of, e.g., silicone-butadiene rubber (40 to 90 hardness), urethane rubber, stainless steel, phosphor bronze (approximately 0.01 to 0.5 mm in thickness), or urethane sheet. The elastic blade 36 is pressed against the surface of the developing roller 35 to coat the surface with the developing agent T. The contact pressure between the elastic blade 36 and the developing roller 35 can be finely adjusted by controlling the position of the blade holder 37.

Part of the surface of the elastic blade 36 opposed to the developing roller 35 is in surface contact with the developing roller 35. Therefore, the contact area between the elastic blade 36 and the developing roller 35 is wider than in the case of the prior art construction in which the free end portion of the elastic blade is pressed against the developing roller. Thus, the fine adjustment of the contact pressure on the developing roller 35 is easy, and the contact pressure can be made uniform. Also, the developing agent can enjoy friction under the contact pressure for a longer time, thus acquiring uniform and sufficient electric charges.

Recovery blade 42 is provided on the lower end of back frame 30 for pressing against developing roller 35. The toner left on the developing roller 35 after the developing operation is recovered into housing 34 by this recovery blade 42.

The developing apparatus 8 is located in a position such that the developing agent layer on the developing roller 35 is not in contact with the photoconductive drum 2. A gap G between the developing roller 35 and the photoconductive drum 2 mainly depends on the charge quantity, the particle size of the developing agent and the thickness of the developing agent layer. To ensure the flight of the developing agent for a visible image of good quality, it is necessary to minimize the gap G. The gap G can be narrowed only if the developing agent layer on the developing roller 35 is a thin layer. The range of the particle size of the developing agent used depends on the resolution of the desired image. This is usually a range of 7 to 20 mm. Thus, the practical gap G between the developing roller 35 and the photoconductive drum 2 ranges from approximately 50 to 400 microns. Here the thin layer may be a monolayer or a multilayer, including up to six or seven layers, of the developing agent.

To maintain the accuracy of the gap G, a pair of gap control rollers 39 are mounted on the shaft of the developing roller 35 so as to be rotatable in a body. The gap control rollers 39 come into contact with both side portions of the peripheral surface of the photoconductive drum 2 or engaging rollers (not shown) mounted on the shaft of the photoconductive drum 2, thereby keeping the intercentral distance between the photoconductive drum 2 and the developing roller 35. A power source 40 is provided for applying a voltage to the developing roller 35 to form an electric field between the photoconductive drum 2 and the developing roller 35 and generally includes D.C. power source or deviated A.C. power source. The power source 40, which is not requisite for the developing apparatus 8 of the invention, serves to facilitate the flight of the developing agent on the developing roller 35 to the surface of the photoconductive drum 2 by forming the electric field between the two members 2 and 35. The developing agent frictionally charged on the developing roller 35 is transferred to the surface of the photoconductive drum 2 by only an electrostatic attraction attributed to latent image charges on the surface of the photoconductive drum 2.

Figure 4:
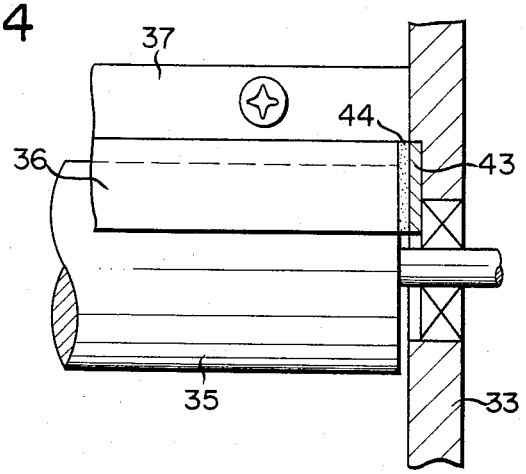
FIG. 4 is a simplified side sectional view showing part of the developing apparatus shown in FIG. 2.

The following is a description, with reference to FIGS. 3 and 4, of the magnet 43 and the magnetic particles 44 which prevent the toner from leaking out. The magnet 43 is attached to each inside surface of the side frames 32 and 33, and faces the region which includes at least the triagular area 46 (shown by crisscross hatching in FIG. 3), which is surrounded by the end surfaces of the elastic blade 36 and the periphery of the developing roller 35. A magnetic toner or iron powder, for example, is used as the magnetic particles 44. These magnetic particles 44 are adhered to the inside surface of magnet 43 filling the gap between the side frames 32, 33 and the elastic blade 36, and the gap between the side frames 32, 33 and the developing roller 35, which arise in the triangular region 46.

The following is a description of the operation of this developing apparatus 3 with reference to FIG. 8. The housing 34 of the developing apparatus 8 is filled with toner and the developing roller 35 rotates counterclockwise as shown by arrow A in FIG. 3. The toner T is conveyed by the developing roller 35 in the direction A and is charged by friction between the elastic blade 36 and the roller. At this time, the magnetic particles 44 adhering to the magnetic 43 fill the gaps which arise in the triangular region 46 between the side frames 32, 33 and the elastic blade 36, and between the side frames 32, 33 and the developing roller 35. These gaps are sealed by these magnetic particles 44 and the toner is prevented from leaking out.

The magnetic particles 44 adhering to the magnet 43 are given a shape which follows the shape of the gaps and thus an elastic shield member is provided to vary this shape. Consequently, the shield can be made to reliably follow the changes in shape of the elastic blade 36.

Figure 5:
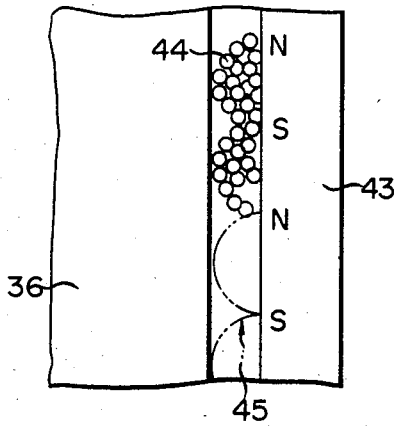
FIG. 5 is a side sectional view showing a magnetic brush enlarged by magnetic particles.

Also, if the magnet 43 is arranged with the S and N poles alternating, as is shown in FIG. 5, the magnetic particles 44 will be connectedly arranged along the magnetic line 45 to fill the gap. In this way, the magnetic particles 44 form a so-called magnetic brush which abuts against the elastic blade 36 and, accordingly, toner leakage is prevented and the elastic deformation of the elastic blade 36 is not obstructed. When the magnetic particles 44 are flown to the developing area, no problem occurs as long as magnetic toner is used as the magnetic particles 44.

This invention is not limited to the structure described in the first embodiment, and may be made in various ways while keeping within the scope and spirit of the invention.

Figure 6:
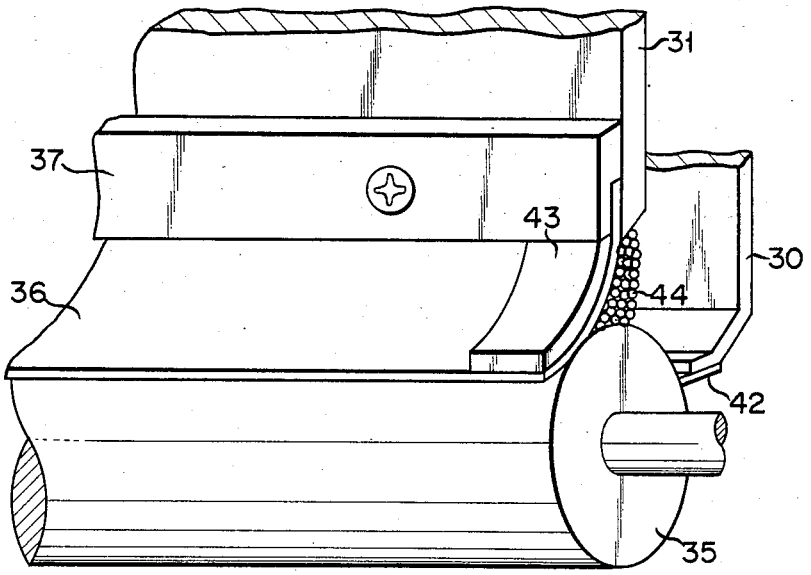
FIG. 6 is a simplified perspective view of the second embodiment of the invention.

For example, the magnets 43 are not restricted to being fastened to the side frames 32, 33. As shown in FIG. 6, in a second embodiment of the invention, the magnets 43 may also be provided at both ends of the elastic blade 36 on the reverse side, which presses against the developing roller 35. In this case, the magnetic particles 44 adhering to the magnets 43, are held at one location regardless of the rotation of the developing roller 35 so it is possible to prevent the leakage of toner at the ends of the elastic blade 36 and the developing roller 35. This effect can be realized providing the magnets 43 inside the elastic blade 36.

Figure 7:
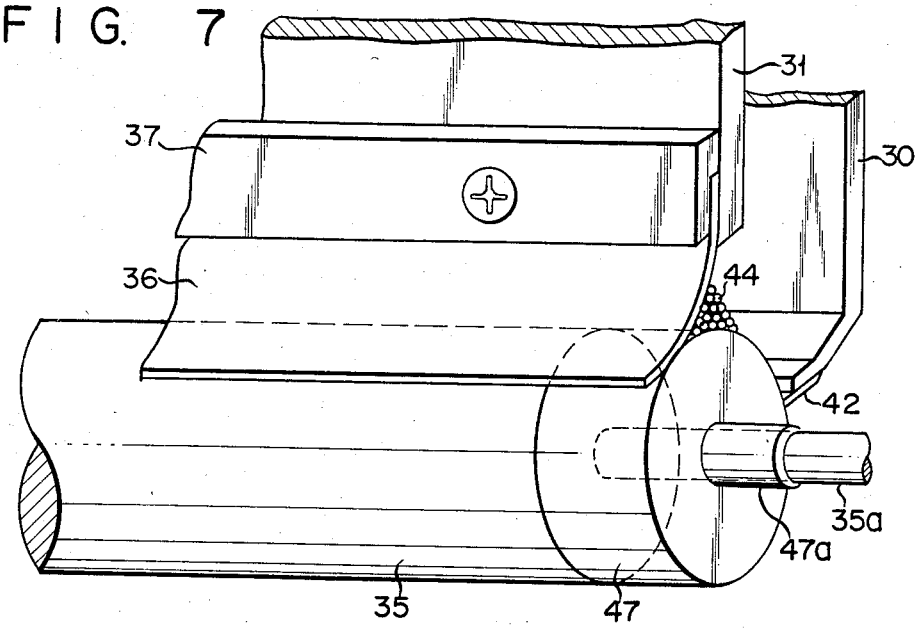
FIG. 7 is simplified perspective view of a third embodiment of the invention.

As means for stopping the magnetic particles 44 at the ends of the elastic blade 36 by pressure to prevent the leakage of toner the magnets may be arranged on the side of the developing roller, as in a third embodiment, which is shown in FIG. 7. Here, a magnet roller 47, which has the same diameter as the developing roller 35, is arranged on both ends of developing roller 35. This magnet roller 47 is hollow in the center, and a hollow projecting journal **47*a* is provided at one end communicating with the hollow of the magnet roller 47. This projecting journal 47*a* is attached to the side frames 32, 33. Central journal 35*a* of developing roller 35 is rotatably supported in the hollow portion of magnet roller 47. In this way, with the structure of the third embodiment, it is possible to keep the magnetic particles at both ends of the elastic blade 36 under the pressure of the blade using the magnet roller 47 attached to the side frames 32, 33 and, consequently, the leakage of toner from the ends of the elastic blade 36 and the developing roller 35** can be prevented.

Figure 8A:
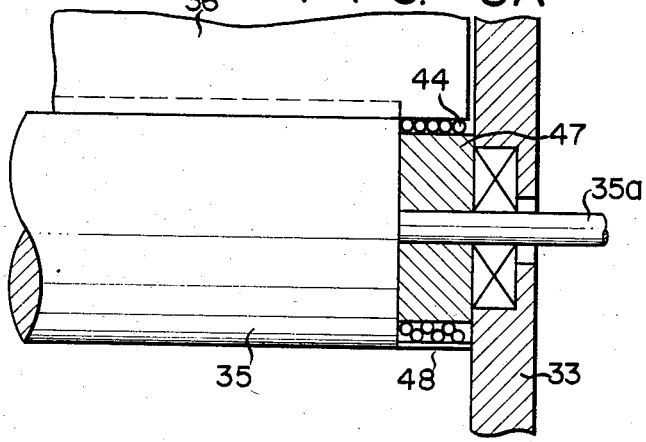
FIGS. 8A and 8B are simplified side and front sectional views showing a fourth embodiment of the invention.
Figure 8B:
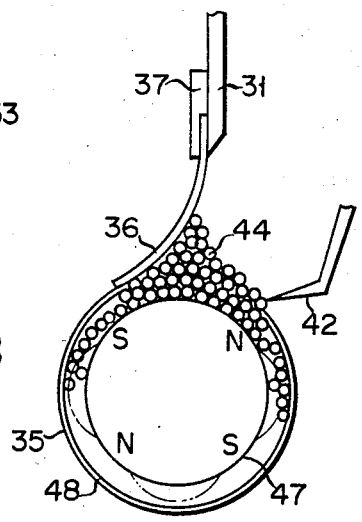

Also, the magnet roller 47, according to a fourth embodiment of this invention as shown in FIGS. 8A and 8B, has a smaller diameter than the developing roller 35 and may rotate as one unit with it. Magnet roller 47, on the surface of which the magnetic particles 44 are adhered, is attached to the central journal **35*a* of developing roller 35. A magnetic particle shield cover 48, which is a thin cylinder, surrounds the magnet roller 47 and has a diameter slightly smaller than that of the developing roller 35. The shield cover 48 has a gap, which covers the area from the edge of recovery blade 42 to the free end of elastic blade 36. With this kind of construction, the magnetic particles are displaced in a flow by the rotation of magnet roller 47, and the ends of the elastic blade 36 and the developing roller 35 are shielded by the magnetic powder 44 which flows out of the opening in the magnetic shield cover 48 due to the pressure of elastic roller 36**, thereby preventing the leakage of toner.

As was described above, according to this invention, it is possible to provide a developing apparatus in which the leakage of toner from the gaps between the ends of the layer forming elastic member and the toner carrier and the facing side walls, thereby keeping the machine clean. Moreover, because the shield is formed by magnetic particles, it is possible to reliably make the magnetic particles follow the deflections of the toner layer forming an elastic member.

What is claimed:

1. A developing apparatus comprising:

a developing agent carrier for carrying a non-magnetic developing agent on a surface thereof;

an elastic member pressed against the surface of the developing agent carrier in one direction to apply the non-magnetic developing agent thereto, so that the non-magnetic developing agent is applied to the surface of the developing agent carrier by the elastic member to form a layer of the non-magnetic developing agent on the surface of the developing agent carrier, and that the layer is opposed to an image bearing member at a predetermined space to deposit the non-magnetic developing agent on a latent image on the image bearing member; and means, provided facing both ends of said developing agent carrier, for preventing the non-magnetic developing agent from dropping off of the surface of the developing agent carrier, said means including:

magnets, each of which covers at least the portions of said elastic member and developing agent carrier in which said elastic member is pressed to the developing agent carrier, and each of which is provided with a specified width facing the ends of the elastic member and developing agent carrier; and magnetic material, which is provided in gaps near the portions of contact between said elastic member and developing agent carrier, and which is attracted by said magnet.

2. A developing apparatus comprising:

a developing agent carrier for carrying a non-magnetic developing agent on a surface thereof;

an elastic member pressed against the surface of the developing agent carrier in one direction to apply the non-magnetic developing agent thereto, so that the non-magnetic developing agent is applied to the surface of the developing agent carrier by the elastic member to form a layer of the non-magnetic developing agent on the surface of the developing agent carrier, and that the layer is opposed to an image bearing member at a predetermined space to deposit the non-magnetic developing agent on a latent image on the image bearing member; and means, provided facing both ends of said developing agent carrier, for preventing the non-magnetic developing agent from dropping off of the surface of the developing agent carrier, said means including:

magnets attached to both ends of said elastic member such that the elastic member is interposed between said magnets and said developing agent carrier; and magnets powder, which is provided near the contacting portion of said elastic member and developing agent carrier, and which is attracted by said magnet.

3. A developing apparatus comprising:

a developing agent carrier for carrying a non-magnetic developing agent on a surface thereof;

an elastic member pressed against the surface of the developing agent carrier in one direction to apply the non-magnetic developing agent thereto, so that the non-magnetic developing agent is applied to the surface of the developing agent carrier by the elastic member to form a layer of the non-magnetic developing agent on the surface of the developing agent carrier, and that the layer is opposed to an image bearing member at a predetermined space to deposit the non-magnetic developing agent on a latent image on the image bearing member; and means, provided facing both ends of said developing agent carrier, for preventing the non-magnetic developing agent from dropping off of the surface of the developing agent carrier, said means including:

magnets, which are provided abutting against both ends of said developing agent carrier and coaxial therewith; and magnetic powder, which is arranged near the contacting portions of said elastic member and developing agent carrier, and which is attracted by said magnet;

wherein said developing agent carrier and magnets are both cylindrical and the magnets are stationary and wherein both ends of said elastic members are pressed against the surface of both magnets.

4. The developing apparatus according to claim 1, which further comprises:

a housing in which at least part of said developing agent carrier is housed, and which is filled with developing agent, the side surfaces of said housing being provided apart from the end surfaces of said elastic member and developing agent carrier, and wherein said magnets are attached to both side surfaces of said housing.

5. The developing apparatus according to claim 1, wherein said magnet is attached to the surface on side of the elastic member which is opposite the side which presses against said developing agent carrier.

6. The developing apparatus according to claim 3, wherein said magnet has a diameter substantially equal to the diameter of said developing agent carrier.

7. The developing apparatus according to claim 3, wherein both ends of said elastic member face the surface of both magnets, respectively.

8. The developing apparatus according to claim 7, wherein said magnet has a diameter smaller than the diameter of said developing carrier.

9. The developing apparatus according to claim 8, wherein said means includes:

sleeves provided on the periphery of each magnet, said sleeves being cylindrical and having a diameter slightly smaller than the diameter of said developing agent carrier, said sleeves having a gap near the portion of said elastic member and developing agent carrier that are in contact.

* * * * *